US008210634B2

(12) United States Patent
Veis et al.

(10) Patent No.: US 8,210,634 B2
(45) Date of Patent: Jul. 3, 2012

(54) IMAGE FORMING APPARATUS AND METHOD THEREOF

(75) Inventors: Alex Veis, Kadima (IL); Jan Van Daele, Bonheiden (BE)

(73) Assignee: Hewlett-Packard Development Company, L.P., Houston, TX (US)

( * ) Notice: Subject to any disclaimer, the term of this patent is extended or adjusted under 35 U.S.C. 154(b) by 231 days.

(21) Appl. No.: 12/842,124

(22) Filed: Jul. 23, 2010

(65) Prior Publication Data

US 2012/0019591 A1 Jan. 26, 2012

(51) Int. Cl.
*B41J 2/205* (2006.01)

(52) U.S. Cl. ..... 347/15; 347/43; 347/95

(58) Field of Classification Search ..... 347/40, 347/43, 15, 12, 95, 98, 100
See application file for complete search history.

(56) References Cited

U.S. PATENT DOCUMENTS 6,137,507 A * 10/2000 Inui et al. ..... 347/43
6,158,834 A * 12/2000 Kato et al. ..... 347/9
6,474,778 B1 * 11/2002 Koitabashi et al. ..... 347/43
2010/0089264 A1 4/2010 Warner

* cited by examiner

*Primary Examiner* — Lamson Nguyen

(57) ABSTRACT

An image forming apparatus includes a fluid receiving member having fluid receiving cells in which the fluid receiving cells are configured to receive at least one of an ink repellant and an ink, a fluid ejector unit configured to eject the ink repellant to a first set of the fluid receiving cells, and an inking unit configured to apply the ink to a second set of the fluid receiving cells.

15 Claims, 7 Drawing Sheets

IMAGE FORMING APPARATUS AND METHOD THEREOF

BACKGROUND

Image forming apparatuses form reproducible images on an intermediate transfer member to be reproduced with ink on substrates such as print media. Image forming apparatuses are in a form of inkjet printers, gravure printers, and the like.

BRIEF DESCRIPTION OF THE DRAWINGS

Exemplary non-limiting embodiments of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

In the following detailed description, reference is made to the accompanying drawings which form a part hereof, and in which is depicted by way of illustration specific exemplary embodiments in which the present disclosure may be practiced. It is to be understood that other embodiments may be utilized and structural or logical changes may be made without departing from the scope of the present disclosure. The following detailed description, therefore, is not to be taken in a limiting sense, and the scope of the present disclosure is defined by the appended claims.

Image forming apparatuses form reproducible images with ink on substrates such as print media. Gravure and flexographic printing apparatuses offer an ability to produce high quality images using a variety of inks through the use of a gravure roller and/or flexo member having ink receptive areas and ink non-receptive areas. For example, in gravure the ink receptive areas are depressed and/or recessed cells configured to retain ink corresponding to an image to be reproduced with the ink on the substrate. Whereas, the ink non-receptive areas are flat, that is, non-depressed areas do not retain ink and in the course of printing operations the residual or excessive ink is removed from them by a doctor blade. The gravure roller and/or flexo member, however, are generally etched thereon to form the respective image to be reproduced on the substrate. Thus, an ability of the gravure roller and/or flexo member to subsequently form other desired images thereon in a cost-effective and timely manner is limited.

In examples of the present disclosure, a fluid receiving member is disclosed having fluid receiving cells to receive at least one of an ink repellent and an ink. A fluid ejector unit may eject the ink repellant to a first set of fluid receiving cells of the fluid receiving member. An inking unit including a fluid trough and/or fluid chamber can apply the ink directly or indirectly, for example, through a metering roller, to the fluid receiving member. The ink from the inking unit may be repelled from the first set of the fluid receiving cells having the ink repellant and may be retained in a second set of the fluid receiving cells not having the ink repellant and corresponding to a desired image to be reproduced with the ink on the substrate. Thus, subsequent desired images may be formed on the fluid receiving member in a cost-effective and timely manner after the previous desired image is transferred to the substrate. Additionally, as the ink applied to the fluid receiving member is not forced through nozzles of the fluid ejector unit, a wide variety of inks can be used.

Figure 1:
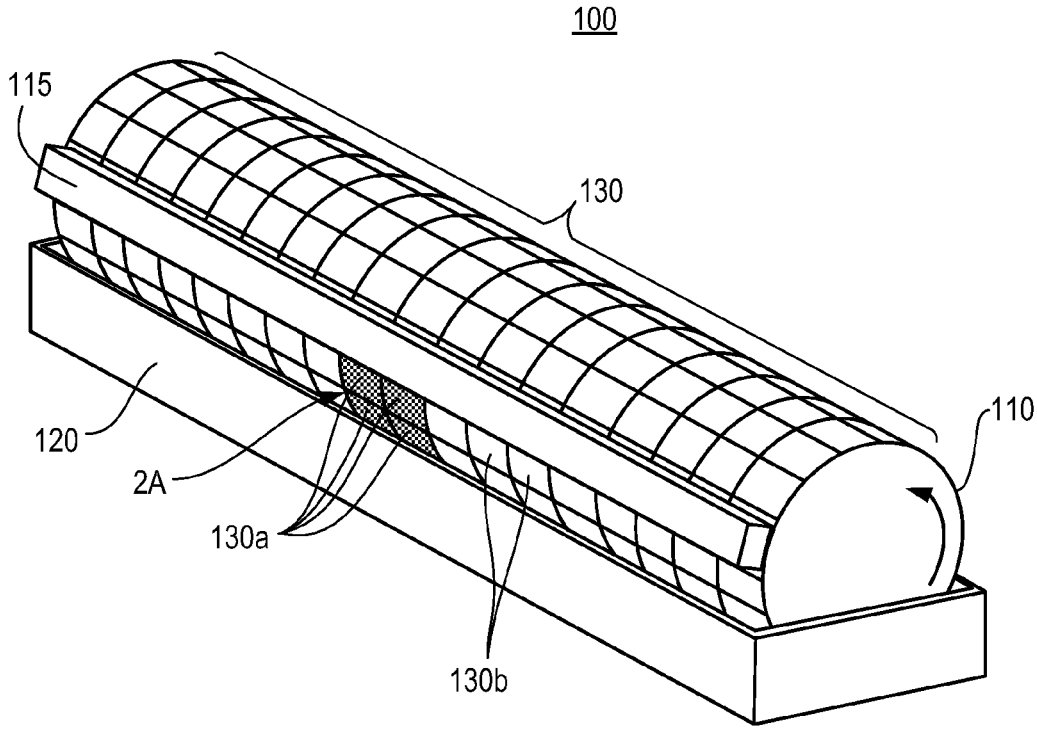
FIG. 1 is a perspective view illustrating an image forming apparatus according to an example of the present disclosure.

FIG. 1 is a perspective view illustrating an image forming apparatus according to an example of the present disclosure. Referring to FIG. 1, an image forming apparatus 100 includes a fluid ejection unit 115, a fluid receiving member 110 disposed across from the fluid ejection unit 115, and an inking unit 120 disposed across from the fluid receiving member 110. The fluid receiving member 110 includes fluid receiving cells 130. The fluid receiving cells 130 are configured to receive at least one of a fluid repellant such as an ink repellant or an ink. In an example, each of the fluid receiving cells 130 may be selectively occupied by either the ink repellant from the fluid ejection unit 115 or the ink from the inking unit 120 at a time.

Figure 2A:
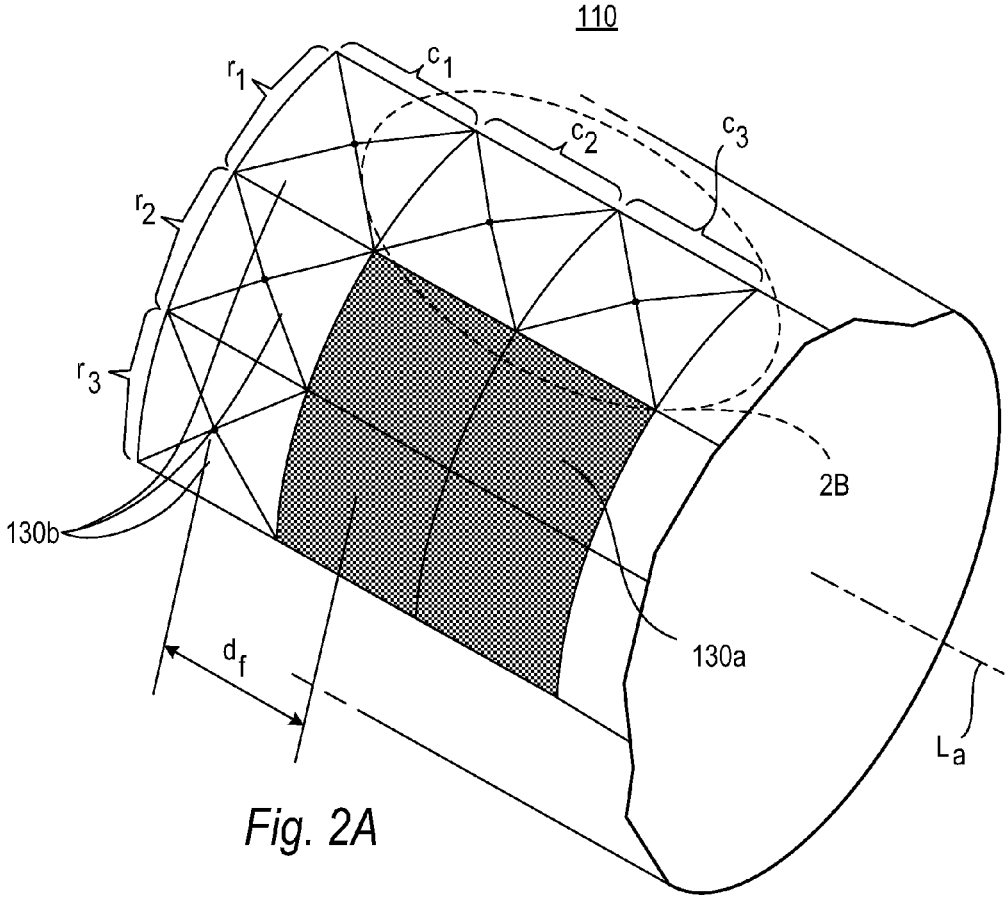
FIG. 2A is an exploded view illustrating a portion of the fluid receiving member of the image forming apparatus of FIG. 1 according to an example of the present disclosure.
Figure 3:
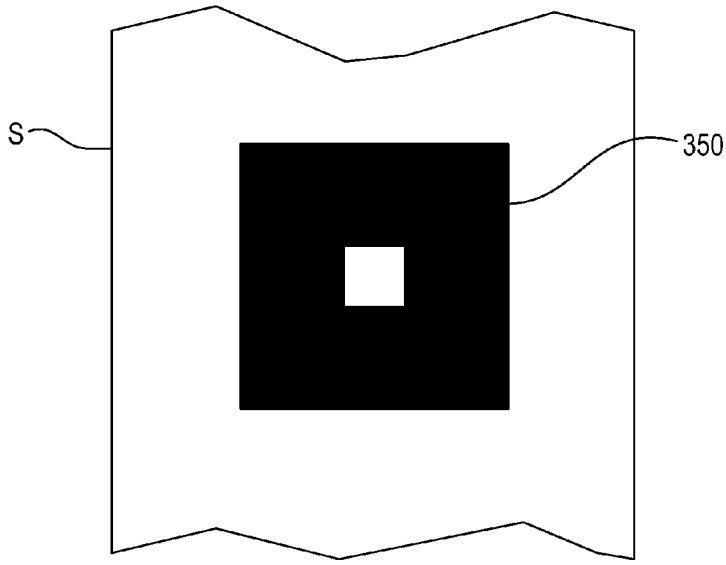
FIG. 3 is a top view illustrating a substrate having a desired image reproduced with ink thereon according to an example of the present disclosure.

FIG. 2A is an exploded view illustrating a portion of the fluid receiving member of the image forming apparatus of FIG. 1 according to an example of the present disclosure. FIG. 3 is a top view illustrating a substrate having a desired image reproduced with ink thereon by the image forming apparatus of FIG. 1 according to an example of the present disclosure. Referring to FIGS. 1, 2A and 3, the image forming apparatus 100 may select fluid receiving cells 130 (e.g., first set 130*a* of fluid receiving cells 130) to receive and retain the ink repellant from the fluid ejection unit 115 to form a complementary image to a desired image 350 (FIG. 3) based on data provided to the image forming apparatus 100. The complementary image, for example, may be a negative image of the desired image 350 (FIG. 3). The image forming apparatus 100 may select a second set 130*b* of fluid receiving cells 130 to receive and retain the ink from the inking unit 120 to form the desired image 350. For purposes of clarity of illustration of the figures, ink is not shown being retained in the second set 130*b* of fluid receiving cells 130. In an example, the second set 130*b* of the fluid receiving cells 130 are all the fluid retaining cells 130 of the fluid receiving member 110 except for the first set 130*a* of the fluid receiving cells 130. Whereas the desired image 350 is intended to ultimately be reproduced with the ink on the substrate S (e.g., reproducible image), the complementary image is not intended to be reproduced with the ink on the substrate S (e.g., non-reproducible image).

Figure 4:
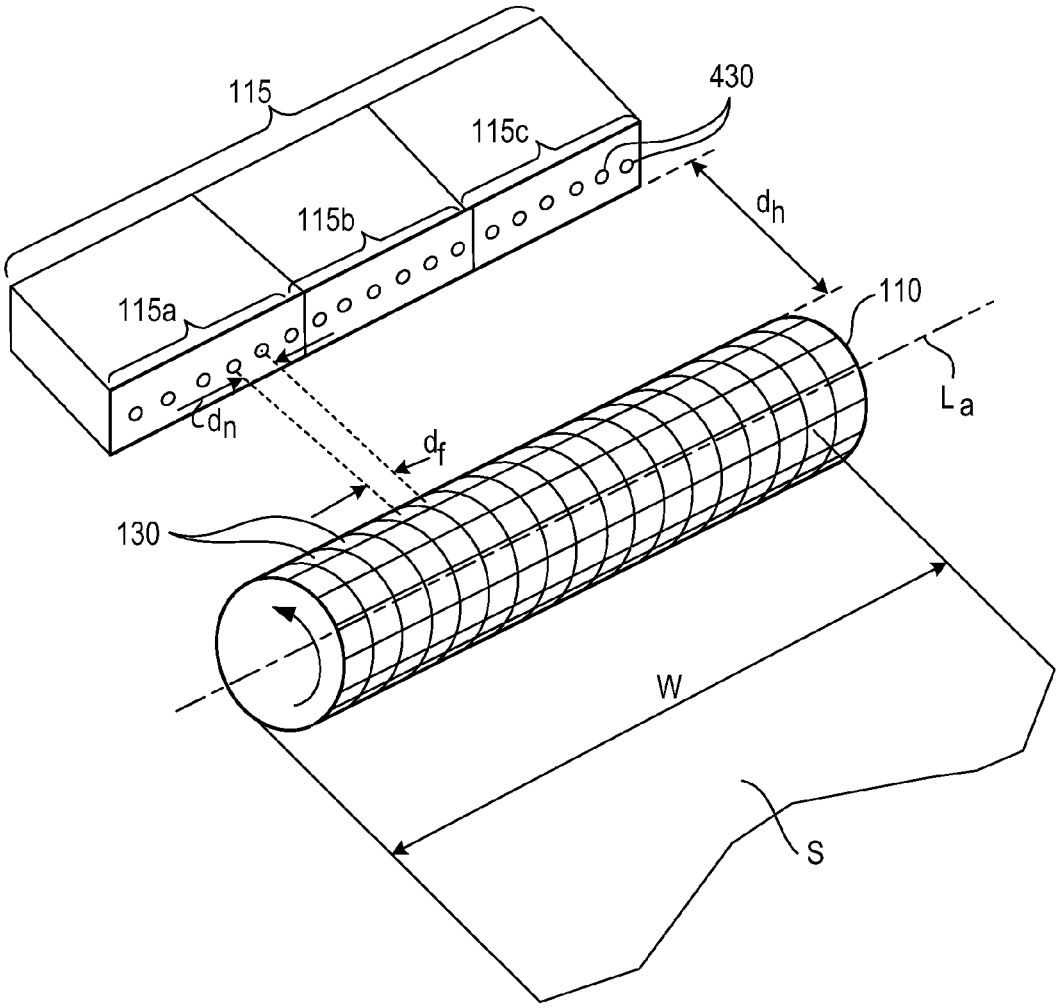
FIG. 4 is a perspective view illustrating a portion of the image forming apparatus of FIG. 1 according to an example of the present disclosure.

Referring to FIGS. 1, 3 and 4, in the present example, the fluid receiving member 110 may rotate along a longitudinal axis $I_a$ thereof to perform rotation cycles. For example, a rotation cycle may be the fluid receiving member 110 rotating approximately 360 degrees about its longitudinal axis thereof. During a rotation cycle, the fluid receiving member 110 may position the respective fluid receiving cells 130*a* and 130*b* to selectively receive the ink repellant corresponding to the non-reproducible image and the ink corresponding to the reproducible image. During this rotation cycle, the fluid receiving member 110 may transfer the reproducible image to the substrate S. During a subsequent rotation cycle, the fluid receiving member 110 may position the respective fluid receiving cells 130*a* and 130*b* to selectively receive the ink repellant corresponding to a subsequent non-reproducible image and the ink corresponding to a subsequent reproducible image. During this subsequent rotation cycle, the fluid receiving member 110 may transfer the subsequent reproducible image to the substrate S. Thus, the respective reproducible images and corresponding non-reproducible images formed on the fluid receiving member 110 may be different from each other during the different rotation cycles. Thus, in examples, the fluid receiving member 110 functions as a variable image carrier.

Referring to FIGS. 1 and 2A, in the present example, the fluid receiving member 110 is an intermediate transfer member in a form of a cylinder such that the first set 130*a* of the fluid receiving cells 130 correspond to the non-reproducible image not to be reproduced with the ink on the substrate S and the second set 130*b* of the fluid receiving cells 130 correspond to the reproducible image to be reproduced with the ink on the substrate S. The fluid receiving member 110 may rotate to allow the fluid ejector unit 115 to eject the ink repellant to the first set 130*a* of the fluid receiving cells 130 and the inking unit 120 to apply the ink to the second set 130*b* of the fluid receiving cells 130. In an example, the inking unit 115 may apply the ink to the second set 130*b* of the fluid receiving cells 130 by applying the ink to an entire surface of the fluid receiving member 110 such that the ink is repelled from the first set 130*a* of the fluid receiving cells 130 having the ink repellant and the ink is transferred to the second set 130*b* of the fluid receiving cells 130. In an example, the fluid receiving member 110 may be in a form of an anylox cylinder in which a matrix of fluid receiving cells thereon, however, are used to form a reproducible image with the ink and a non-reproducible image with the ink repellant, rather than just supplying an accurate amount of ink, for example, to a gravure roller. Thus, in an example, the fluid receiving member 110 may include an anylox roller having an outer surface completely covered with fluid receiving cells 130 in which ink repellant and ink are selectively provided to and retained in the respective fluid receiving cells to form a non-reproducible image and a reproducible image thereon, respectively.

Figure 2B:
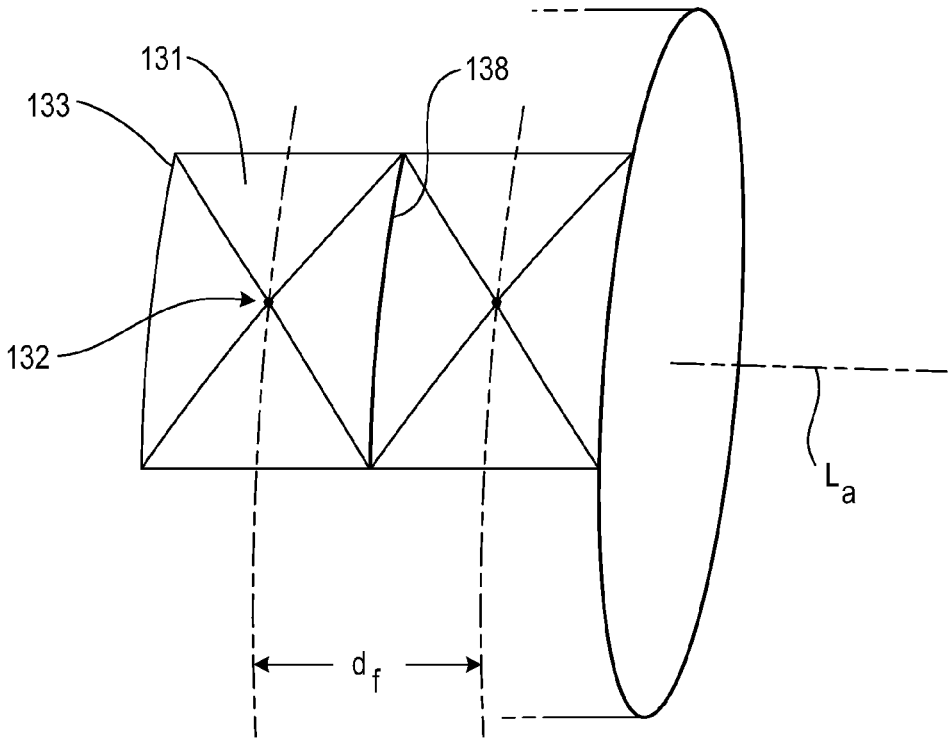
FIG. 2B is an exploded view illustrating a portion of the fluid receiving member of FIG. 2A according to an example of the present disclosure.
Figure 2C:
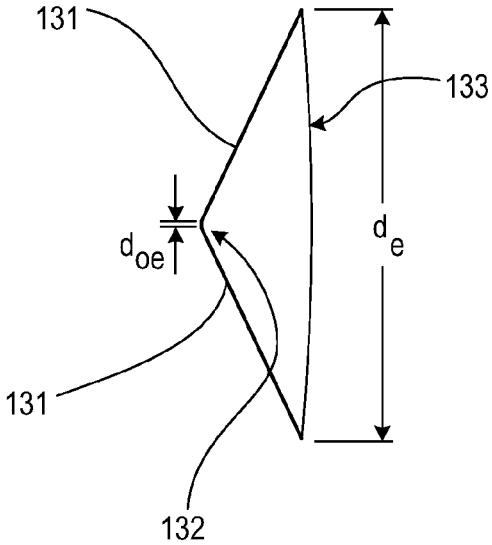
FIG. 2C is a side view illustrating a respective fluid receiving cell of the fluid receiving member of FIG. 2A according to an example of the present disclosure.

FIG. 2B is an exploded view illustrating a portion of the fluid receiving member of FIG. 2A according to an example of the present disclosure. FIG. 2C is a side view illustrating a respective fluid receiving cell illustrated in FIG. 2B according to an example of the present disclosure. Referring to FIGS. 2A-2C, the fluid receiving cells 130 may be arranged in a form of a matrix having a plurality of rows $r_1$, $r_2$, $r_3$, etc., and a plurality of columns $c_1$, $c_2$, $c_3$, etc., such as a mesh and/or grid, for example, separated from each other by walls 138 having a top surface of a predetermined thickness (not illustrated) and wall portions 131. Numerous fluid receiving cells 130 may be included in the matrix and arranged with a high degree of accuracy. In the present example, each of the fluid receiving cells 130 may be separated from each other by a uniform on-center distance $d_f$. In an example, each of the fluid receiving cells 130 includes a recessed compartment 132 having an opening 133 for the fluid to pass therethrough and a respective wall portion 131 forming the recessed compartment 132. In examples, a shape of the opening 133 may be square, rectangular, diamond, elliptical, circular, or any other shape. Referring to FIG. 2B, the recessed compartment 132 is configured to receive the fluid such as the ink repellant or the ink. The wall portion 131 may include at least one of a curved surface and tapered surface. In an example, the fluid receiving cells 130 may have wall portions 131 having tapered surfaces opposite each other. The tapered surfaces may slope outward toward the opening 133 of the fluid receiving member 110 such that a distance $d_e$ between ends of the tapered surface at the opening 133 is greater than a distance $d_{oe}$ between other ends of the respective tapered surfaces.

FIG. 4 is perspective view illustrating a portion of the image forming apparatus of FIG. 1 according to an example of the present disclosure. Referring to FIG. 4, the fluid ejector unit 115 includes inkjet print heads 115*a*, 115*b* and 115*c* having nozzles 430, the inkjet print heads 115*a*, 115*b* and 115*c* are arranged next to each other in a side by side manner forming at least one row of the nozzles 430 extending across a width W of the substrate S such that each fluid receiving cell in a respective row of the matrix of the fluid receiving member 110 corresponds to a respective nozzle in the at least one row of the nozzles 430. For example, an on-center distance $d_n$ between adjacent nozzles in the fluid ejector unit 115 may equal the on-center distance $d_f$ between adjacent fluid receiving cells 130 of the fluid receiving member 110. The inkjet print heads 115*a*, 115*b* and 115*c* may be in close proximity to the fluid receiving member 110. For example, a distance $d_h$ between the inkjet print heads 115*a*, 115*b* and 115*c* and the fluid receiving member 110 may be in a range of 100 to 1500 microns. Such a short distance between the inkjet print heads 115*a*, 115*b* and 115*c* and the fluid receiving member 110 reduces impact that may be produced by formation of potential unwanted satellite droplets that are absorbed by the same target cell. Also effects of drop velocity variations between different nozzles are greatly reduced.

In the present example, the fluid ejector unit 115 ejects the ink repellant in a form of droplets to the first set 130*a* of the fluid receiving cells 130 of the fluid receiving member 110. The ink repellant may be water such as purified water or a mixture of primarily water with one or more additives, for example, to enhance properties of the water such as wetting properties, and the like. In addition, using water as the ink repellant may increase reliability and performance of the fluid ejector unit 115 due to its reduced clogging potential, and the like. Furthermore, the fluid ejector unit 115 may be simplified as a need for ink agitators and inkjet print head heating to prevent ink clogging of the nozzles is reduced.

Figure 5A:
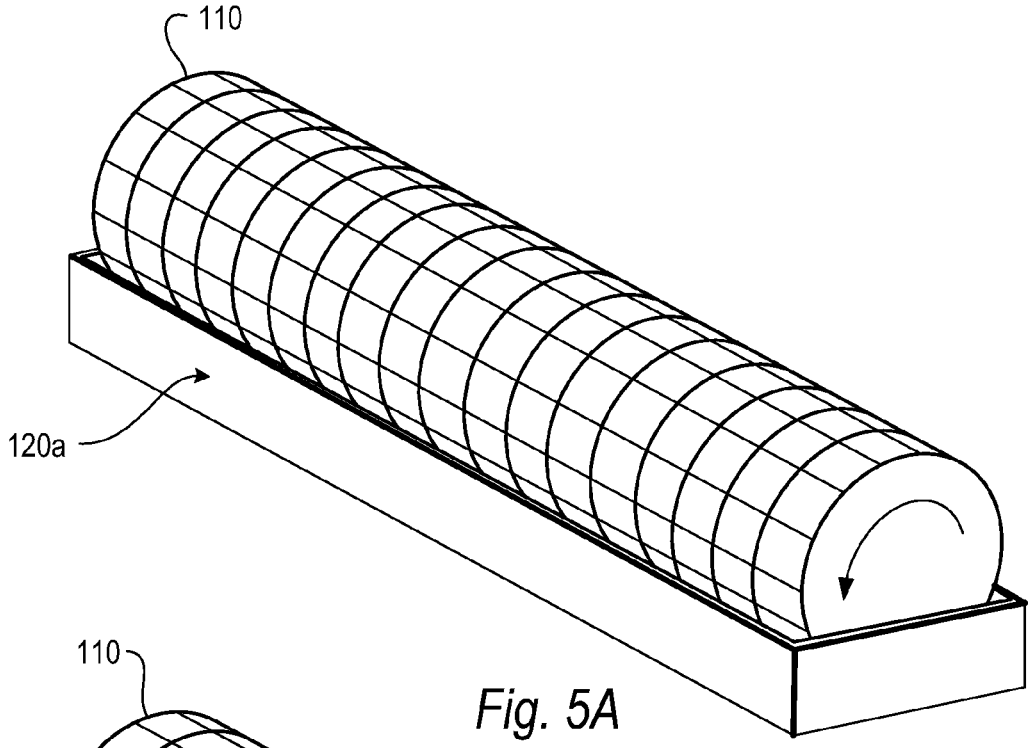
FIGS. 5A and 5B are side views illustrating an inking unit of the image forming apparatus of FIG. 1 according to examples of the present disclosure.
Figure 5B:
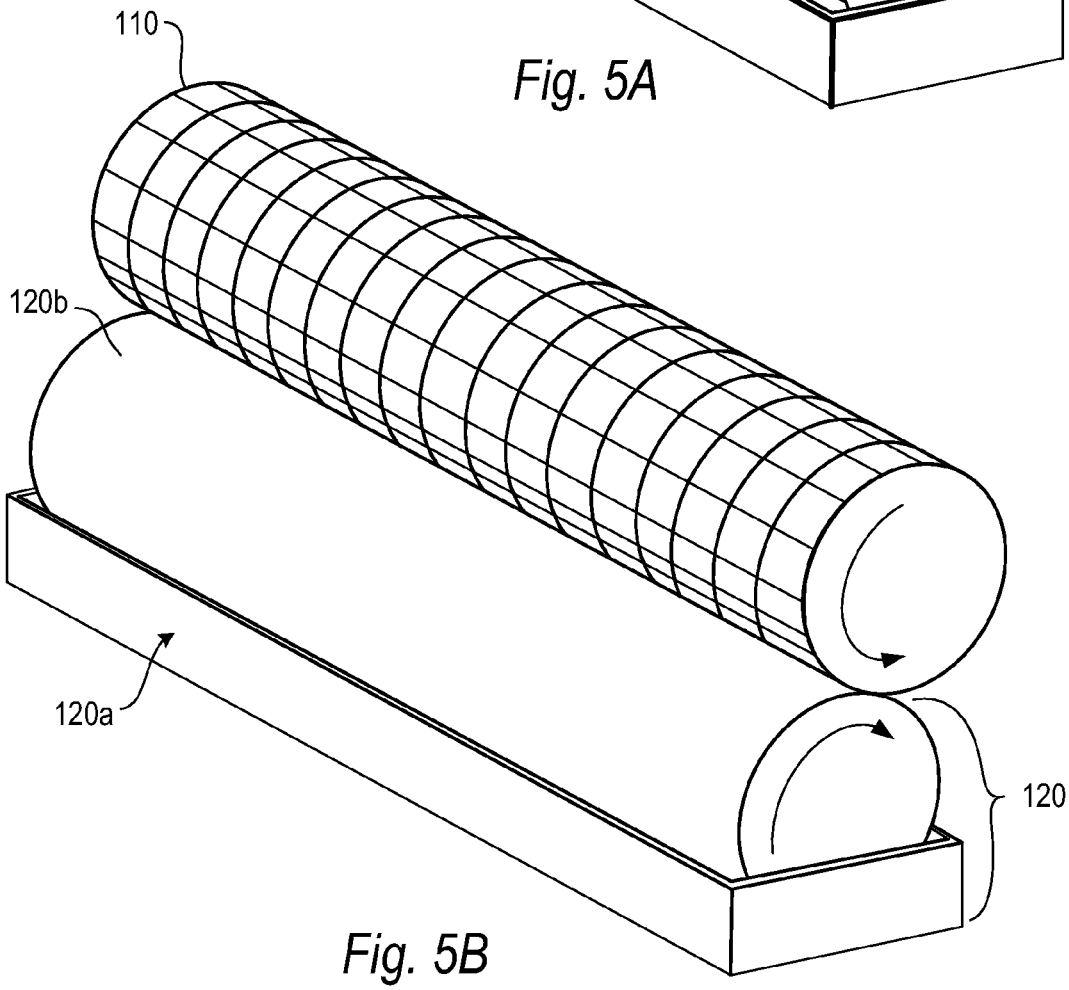

FIGS. 5A and 5B are side views illustrating an inking unit of the image forming apparatus of FIG. 1 according to examples of the present disclosure. Referring to FIGS. 1, 5A and 5B, the inking unit 120 includes a fluid chamber 120*a* configured to hold the ink. In an example, the ink may include offset inks, gravure printing inks, and other variety of inks of varying densities as such inks does not have to pass through nozzles 430 (FIG. 4) of an inkjet print head 115*a*, 115*b* and 115*c* (FIG. 4). In the present example, the fluid receiving member 110 is immersed in the fluid of the fluid chamber 120*a* and in fluid communication therewith. That is, the fluid receiving member 110 is directly receiving the fluid from the ink chamber 120*a* while immersed therein. In other examples, the inking unit 120 may also include at least one inking roller 120*b* immersed in the fluid in the fluid chamber as illustrated in FIG. 5B. Thus, the inking roller 120*b*, rather than the fluid receiving member 110, is immersed in the fluid of the ink chamber 120*a*. Accordingly, in this example, the metering roller 121 may apply the fluid of the fluid chamber 120*a* to the fluid receiving member 110 placing the fluid receiving member 110 in fluid communication with the fluid chamber 120*a*. Referring to FIGS. 5A and 5B, in the present example, the inking unit 120 is configured to apply the ink to the second set 130*b* of the fluid receiving cells 130 including the ink in the fluid chamber 120*a* flowing into the recessed compartments 132 (FIG. 2B) of the second set 130*b* of the fluid receiving cells 130, and the ink in the fluid chamber 120*a* repelling away from the recessed compartments 132 of the first set 130*a* of the fluid receiving cells 130 having the ink repellant stored therein in response to a rotation of the fluid receiving member 110.

Figure 6:
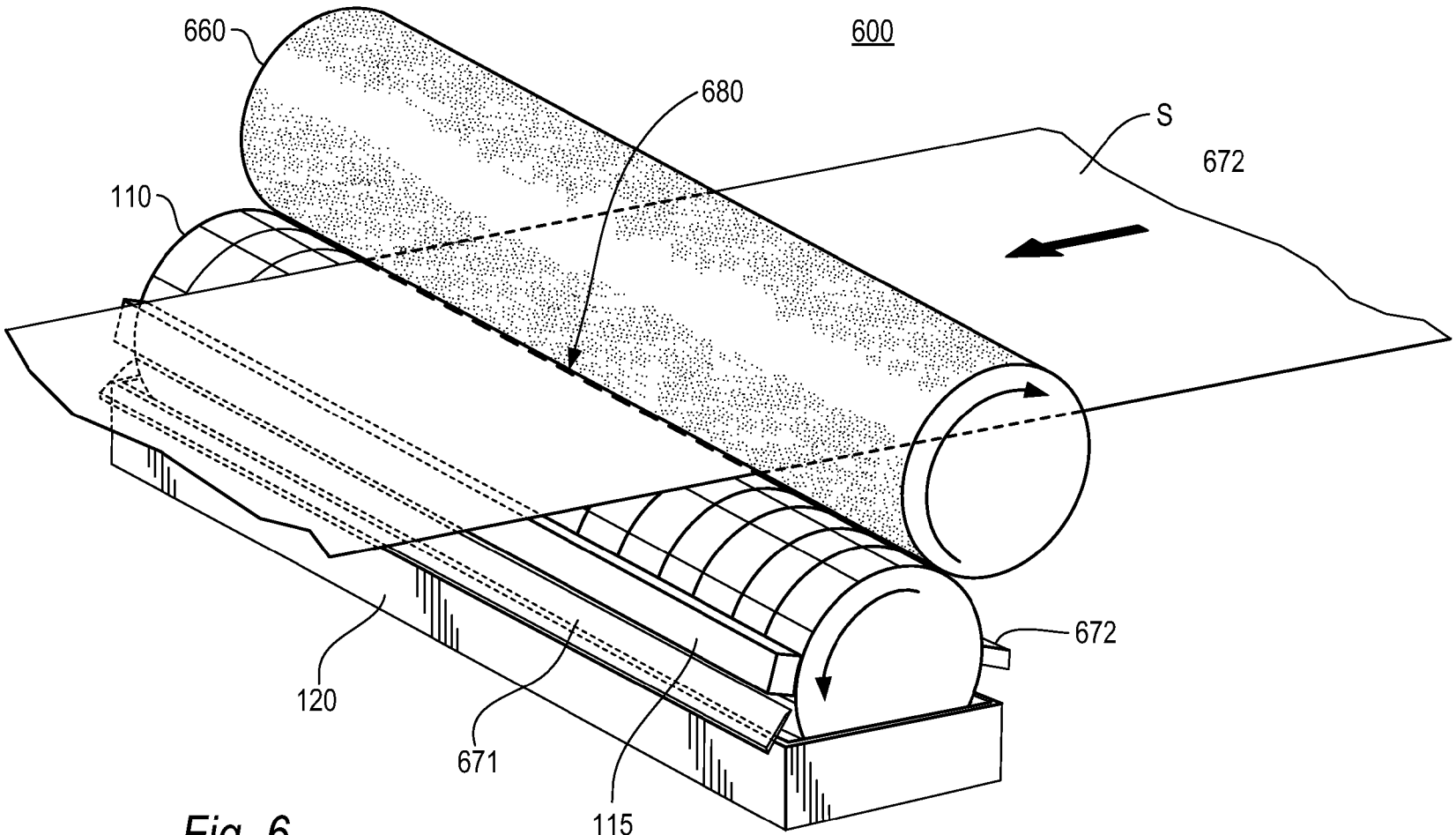
FIG. 6 is a perspective view illustrating an image forming apparatus according to an example of the present disclosure.

FIG. 6 is a perspective view illustrating an image forming apparatus according to an example of the present disclosure. Referring to FIG. 6, an image forming apparatus 600 includes the fluid ejection unit 115, the fluid receiving member 110 disposed across from the fluid ejection unit 115, and the inking unit 120 disposed across from the fluid receiving member 110 as previously disclosed with reference to FIG. 1. Additionally, in the present example, the image forming apparatus 600 may include a first doctor blade 671, a second doctor blade 672, and an impression member 660 proximate to the fluid receiving member 110. The first doctor blade 671 is configured to remove excess ink repellant provided by the fluid ejector unit 115 from the fluid receiving member 110. The second doctor blade 672 is configured to remove excess ink provided by the inking unit 120 from the fluid receiving member 110. The impression member 660 and the fluid receiving member 110 are configured to receive a substrate S in a substrate receiving area 680 therebetween. The impression member 660 is configured to apply adequate pressure to transfer the ink from the fluid receiving member 110 to the substrate S.

In other examples, the image forming apparatus 660 of FIG. 6 may also include an offset roller, vacuum system, and a cleaning system (not illustrated). The offset roller may be disposed between the fluid receiving member 110 and the impression roller 660. In such examples, the offset roller is configured to receive the reproducible image with the ink from the fluid receiving member 110 and to transfer the reproducible image to the substrate S. The vacuum system may be downstream from the second doctor blade 672 to remove the ink repellant from the fluid receiving member 110 after the inking unit 120 applies the ink and prior to the transfer of the reproducible image to the substrate S. The vacuum system may include a suction slit having a length equal or larger to the length of the fluid receiving member 110 and a suction/vacuum pump. The suction pressure is selected to remove the ink repellent fluid such as water that may be substantially lighter, for example, than the ink. The cleaning system may be downstream from the impression roller 660 to clean the fluid receiving member 110 after the transfer of the desired image 350 (FIG. 3) to the substrate S. The cleaning system may include a spraying system dispersing ink cleaning material over the cylinder surface, a brush to remove ink residuals, and/or a cylinder drying system, or the like. In an example as illustrated in FIG. 1, and for purposes of clarity of illustration, the image forming apparatus 100 is illustrated with a single color printing unit. In other examples, additional printing units may be included to print multiple colors. For example, the image forming apparatus 100 may be a color press including four of such printing units each capable of printing with a different color such as cyan, magenta, yellow and black.

Referring to FIG. 6, in operation, the fluid ejection unit 115 ejects the ink repellant to the first set 130*a* of fluid receiving cells 130 of the fluid receiving member 110 corresponding to the non-reproducible image not to be reproduced with the ink on the substrate S. The first doctor blade 671 removes excess ink repellant from the surface S of the fluid receiving member 110 as the fluid receiving member 110 rotates while in contact with the first doctor blade 671. The fluid receiving member 110 is rotated in the fluid chamber of the inking unit 120. The inking unit 120 applies the ink to a surface of the fluid receiving member 110 such that the ink is repelled from the first set 130*a* of fluid receiving cells 130 having the ink repellant and the ink is retained by the second set 130*b* of the fluid receiving members 110 corresponding to the reproducible image to be subsequently reproduced on the substrate S with the ink. The second doctor blade 672 removes excess ink from the surface of the fluid receiving member 110 as the fluid receiving member 110 rotates while in contact with the second doctor blade 672. The impression member 660 and the fluid receiving member 110 are configured to receive the substrate S in the substrate receiving area 680 therebetween. The impression member 660 contacts the substrate S and presses the substrate S against the fluid receiving member 110 such that the ink retained in the second set 130*b* of fluid receiving cells 130 thereof corresponding to the reproducible image is transferred to the substrate S.

Figure 7:
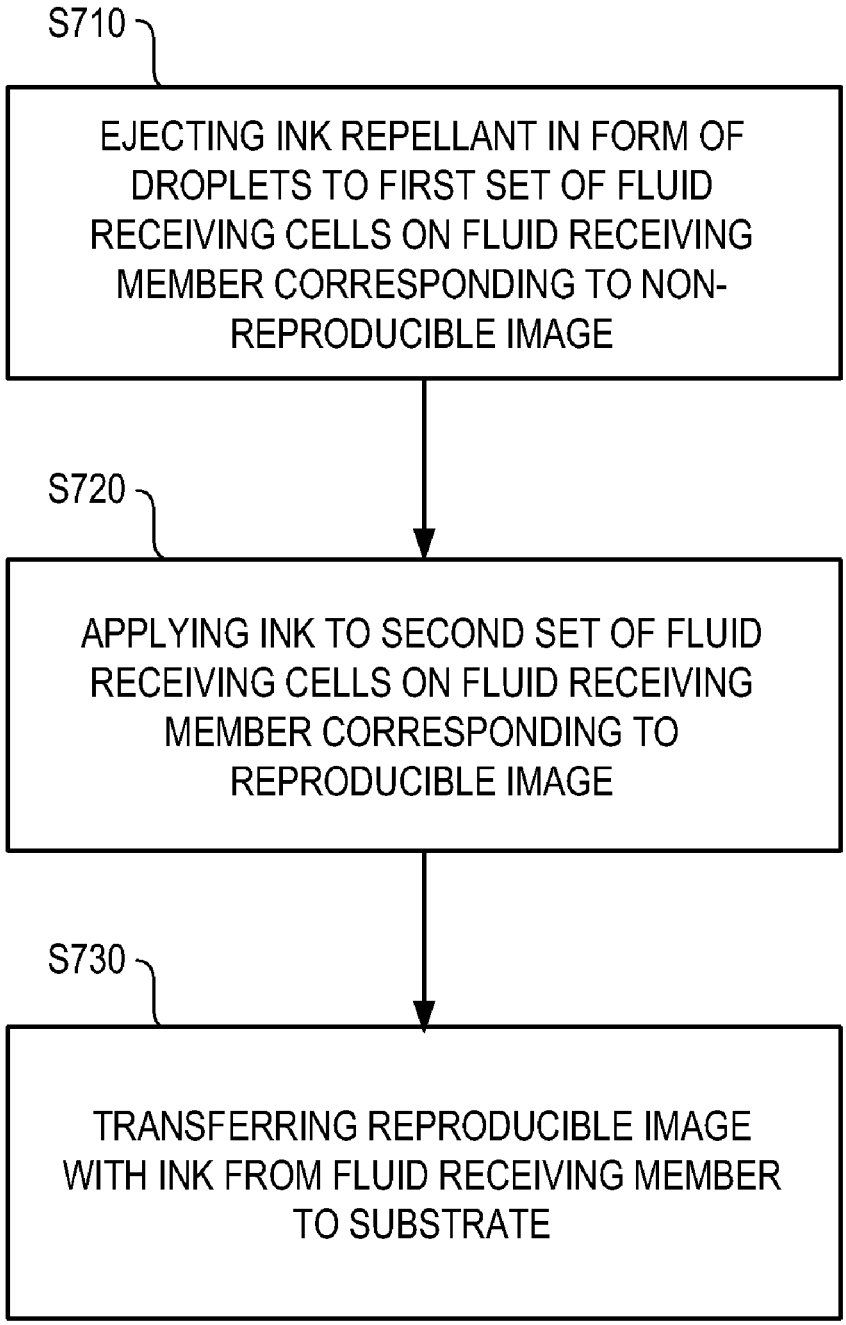
FIG. 7 is a flowchart illustrating a method of forming a reproducible image on a substrate according to an example of the present disclosure.

FIG. 7 is a flowchart illustrating a method of forming a reproducible image on a substrate according to an example of the present disclosure. Referring to FIGS. 2A and 7, in block 710, an ink repellant in ejected in a form of droplets to a first set of fluid receiving cells on a fluid receiving member corresponding to a non-reproducible image. In block 720, ink is applied to a second set of the fluid receiving cells on the fluid receiving member corresponding to a reproducible image. In block 730, the reproducible image with the ink from the fluid receiving member is transferred to a substrate.

In an example, applying ink to a second set of the fluid receiving cells on the fluid receiving member may include applying the ink to the fluid receiving member, repelling the ink from the first set of the fluid receiving cells having the ink repellant, and transferring the ink to the second set of the fluid receiving cells. In the present example, the ink repellant may be water such as purified water or a mixture of primarily water with one or more additives, for example, to enhance properties of the water such as wetting properties, and the like. In an example, the fluid receiving member includes an intermediate transfer member in a form of a cylinder such that the non-reproducible image corresponding to the first set of the fluid receiving cells is not transferred with the ink to the substrate.

In the present example, the fluid receiving member may rotate along a longitudinal axis thereof to perform rotation cycles. During a rotation cycle, the fluid receiving member may position the respective fluid receiving cells to selectively receive the ink repellant corresponding to the non-reproducible image and the ink corresponding to the reproducible image. During this rotation cycle, the fluid receiving member may transfer the reproducible image to the substrate. During a subsequent rotation cycle, the fluid receiving member may position the respective fluid receiving cells to selectively receive the ink repellant corresponding to a subsequent non-reproducible image and the ink corresponding to a subsequent reproducible image. During this subsequent rotation, the fluid receiving member may transfer the subsequent reproducible image to the substrate. Thus, the respective reproducible images and corresponding non-reproducible images formed on the fluid receiving member may be different from each other during the different rotation cycles.

The present disclosure has been described using non-limiting detailed descriptions of example embodiments thereof that are provided by way of example and are not intended to limit the scope of the present disclosure. It should be understood that features and/or operations described with respect to one example may be used with other examples and that not all examples of the present disclosure have all of the features and/or operations illustrated in a particular figure or described with respect to one of the embodiments. Variations of embodiments described will occur to persons of the art. Furthermore, the terms "comprise," "include," "have" and their conjugates, shall mean, when used in the present disclosure and/or claims, "including but not necessarily limited to."

It is noted that some of the above described embodiments may describe examples contemplated by the inventors and therefore may include structure, acts or details of structures and acts that may not be essential to the present disclosure and which are described as examples. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. An image forming apparatus, comprising:

a fluid receiving member having a plurality of fluid receiving cells, the fluid receiving cells are configured to receive at least one of an ink repellant and an ink;

a fluid ejector unit disposed across from the fluid receiving member, the fluid ejector unit configured to eject the ink repellant to a first set of the fluid receiving cells; and an inking unit disposed across from the fluid receiving member, the inking unit configured to apply the ink to a second set of the fluid receiving cells.

2. The apparatus according to claim 1, wherein the fluid ejector unit ejects the ink repellant in a form of droplets to the first set of the fluid receiving cells.

3. The apparatus according to claim 2, wherein the ink repellant is water.

4. The apparatus according to claim 3, wherein the fluid receiving member comprises:

an intermediate transfer member in a form of a cylinder such that the first set of the fluid receiving cells correspond to a non-reproducible image and the second set of the fluid receiving cells correspond to a reproducible image.

5. The apparatus according to claim 4, wherein the plurality of the fluid receiving cells are arranged in a form of a matrix having a plurality of rows and a plurality of columns, each of the plurality of fluid receiving cells including a recessed compartment having an opening for the fluid to pass therethrough and a wall portion forming the recessed compartment, the recessed compartment configured to receive the fluid.

6. The apparatus according to claim 5, wherein the fluid ejector unit comprises:

a plurality of inkjet print heads having nozzles, the inkjet print heads are arranged next to each other in a side by side manner extending across a width of the substrate such that each fluid receiving cell in a respective row of the matrix of the fluid receiving member corresponds to a respective nozzle of one of the inkjet print heads.

7. The apparatus according to claim 5, wherein the inking unit comprises:

a fluid chamber configured to hold the ink and be in fluid communication with the fluid receiving member.

8. The apparatus according to claim 7, wherein the inking unit configured to apply the ink to a second set of the fluid receiving cells comprises the fluid from the fluid chamber flowing into the recessed compartments of the second set of the fluid receiving cells and the fluid from the fluid chamber repelling away from the recessed compartments of the first set of the fluid receiving cells having the ink repellant stored therein in response to a rotation of the fluid receiving member.

9. The apparatus according to claim 1, further comprising:

a first doctor blade and a second doctor blade in contact with the fluid receiving member, the first doctor blade is configured to remove excess ink repellant provided by the fluid ejector unit from the fluid receiving member and the second doctor blade is configured to remove excess ink provided by the inking unit from the fluid receiving member; and an impression member forming a substrate receiving area to receive a substrate, the impression member is configured to apply adequate pressure to transfer the ink from the fluid receiving member to the substrate.

10. A method of forming a reproducible image on a substrate, the method comprising:

ejecting an ink repellant in a form of droplets to a first set of fluid receiving cells on a fluid receiving member corresponding to a non-reproducible image;

applying ink to a second set of the fluid receiving cells on the fluid receiving member corresponding to a reproducible image; and transferring the reproducible image with the ink from the fluid receiving member to a substrate.

11. The method according to claim 10, wherein the ink repellant is water.

12. The method according to claim 11, wherein applying ink to a second set of the fluid receiving cells on the fluid receiving member comprises:

applying the ink to the fluid receiving member;

repelling the ink from the first set of the fluid receiving cells having the ink repellant; and transferring the ink to the second set of the fluid receiving cells.

13. The method according to claim 12, wherein the fluid receiving member comprises:

an intermediate transfer member in a form of a cylinder such that the non-reproducible image corresponding to the first set of the fluid receiving cells is not transferred with the ink to the substrate.

14. The method according to claim 10, wherein the fluid receiving member rotates along a longitudinal axis thereof to perform a plurality of rotation cycles, the fluid receiving member positions the respective fluid receiving cells to selectively receive the ink repellant corresponding to the non-reproducible image and the ink corresponding to the reproducible image, and to transfer the reproducible image to the substrate in response to a rotation cycle.

15. The method according to claim 14, wherein the respective fluid receiving cells selectively receive the ink repellant corresponding to a subsequent non-reproducible image and the ink corresponding to a subsequent reproducible image, and to transfer the subsequent reproducible image to the substrate in response to a subsequent rotation cycle.

* * * * *